US005156554A

United States Patent [19]

Rudoy et al.

[11] Patent Number: 5,156,554

[45] Date of Patent: * Oct. 20, 1992

[54] CONNECTOR INTERCEPTOR PLATE ARRANGEMENT

[75] Inventors: Edward Rudoy, Woodland Hills; Michael A. Lin, Irvine, both of Calif.

[73] Assignee: ITT Corporation, Secaucus, N.J.

[ * ] Notice: The portion of the term of this patent subsequent to Aug. 21, 2007 has been disclaimed.

[21] Appl. No.: 733,503

[22] Filed: Jul. 22, 1991

Related U.S. Application Data

[63] Continuation-in-part of Ser. No. 525,936, May 18, 1990, Pat. No. 5,035,632, which is a continuation-in-part of Ser. No. 419,405, Oct. 10, 1989, Pat. No. 4,950,172.

[51] Int. Cl.[5] ..... H01R 13/648

[52] U.S. Cl. ..... 439/108; 439/62; 439/607

[58] Field of Search ..... 439/59, 62, 65, 69, 439/92, 108, 607, 741, 743

[56] References Cited

U.S. PATENT DOCUMENTS

| | | | |
|---|---|---|---|
| 3,587,029 | 6/1971 | Knowles | 439/607 |
| 3,871,728 | 3/1975 | Goodman | 439/607 |
| 4,070,084 | 1/1978 | Hutchison | 439/608 |
| 4,148,543 | 4/1979 | Shores | 439/608 |
| 4,226,496 | 10/1980 | Langham | 439/637 |
| 4,232,929 | 11/1980 | Zobawa | 439/607 |
| 4,386,814 | 6/1983 | Asick | 439/607 |
| 4,407,552 | 10/1983 | Watanabe et al. | 439/608 |
| 4,418,972 | 12/1983 | Benasutti | 439/607 |
| 4,511,196 | 4/1985 | Schuler et al. | 439/96 |
| 4,550,960 | 11/1985 | Asick et al. | 439/108 |
| 4,552,420 | 11/1985 | Eigenbrode | 439/92 |
| 4,571,014 | 2/1986 | Robin et al. | 439/108 |
| 4,601,527 | 7/1986 | Lemke | 439/95 |
| 4,616,893 | 10/1986 | Feldman | 439/108 |
| 4,619,494 | 10/1986 | Noorily et al. | 439/449 |
| 4,632,476 | 12/1986 | Schell | 439/95 |
| 4,634,199 | 1/1987 | Anhalt et al. | 439/69 |
| 4,641,901 | 2/1987 | Brennan et al. | 439/344 |
| 4,653,837 | 3/1987 | Phillipson et al. | 439/607 |
| 4,653,840 | 3/1987 | Grabbe et al. | 439/608 |
| 4,655,515 | 4/1987 | Hamsher, Jr. et al. | 439/108 |
| 4,687,267 | 8/1987 | Header et al. | 439/62 |
| 4,695,106 | 9/1987 | Feldman et al. | 439/83 |
| 4,708,412 | 11/1987 | Himes, Jr. et al. | 439/95 |
| 4,726,638 | 2/1988 | Farrar et al. | 439/620 |
| 4,731,031 | 3/1988 | Lemke | 439/96 |
| 4,743,080 | 5/1988 | Siraty | 439/492 |
| 4,747,787 | 5/1988 | Siwinski | 439/108 |
| 4,752,231 | 6/1988 | Olsson | 439/66 |
| 4,761,147 | 8/1988 | Gauthier | 439/607 |
| 4,773,878 | 9/1988 | Hansell, III | 439/92 |
| 4,789,358 | 12/1988 | Zell et al. | 439/607 |
| 4,806,109 | 2/1989 | Manabe et al. | 439/108 |
| 4,806,110 | 2/1989 | Lindeman | 439/108 |
| 4,822,304 | 4/1989 | Herron | 439/610 |
| 4,869,672 | 9/1989 | Andrews, Jr. | 439/60 |
| 4,872,851 | 10/1989 | Babuka et al. | 439/635 |
| 4,908,335 | 3/1990 | Cosmos et al. | 439/609 |

FOREIGN PATENT DOCUMENTS 1915114 3/1969 Fed. Rep. of Germany .

*Primary Examiner*—Gary F. Paumen
*Attorney, Agent, or Firm*—Thomas L. Peterson

[57] ABSTRACT

A connector is provided of the type that has rows of contacts, which minimizes crosstalk between adjacent contacts. An interceptor plate (60, FIG. 2) which is grounded or at another controlled potential, extends along each row of contacts (34), the plate lying close to the row to provide better capacitive coupling between each contact and the plate than between contacts of the same or different rows. The space between each contact leg and an adjacent interceptor plate, contains a dielectric whose dielectric constant varies by no more than four per cent between 1 kHz and 100 MHz. The capacitance between each contact and an adjacent interception plate is at least three times the capacitance between adjacent contacts of a row.

8 Claims, 8 Drawing Sheets

FIG. 4
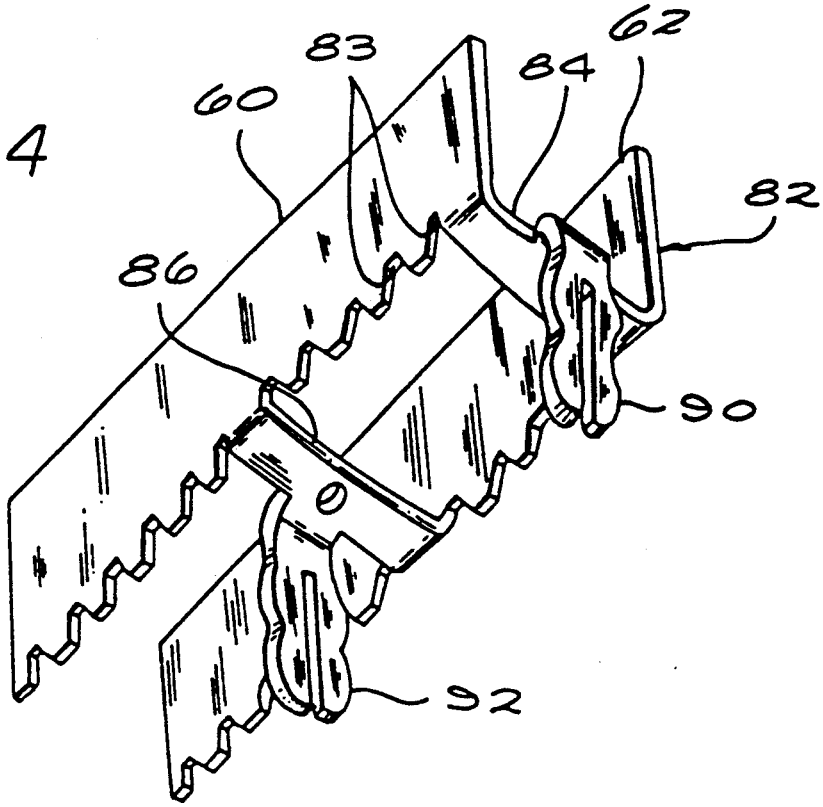
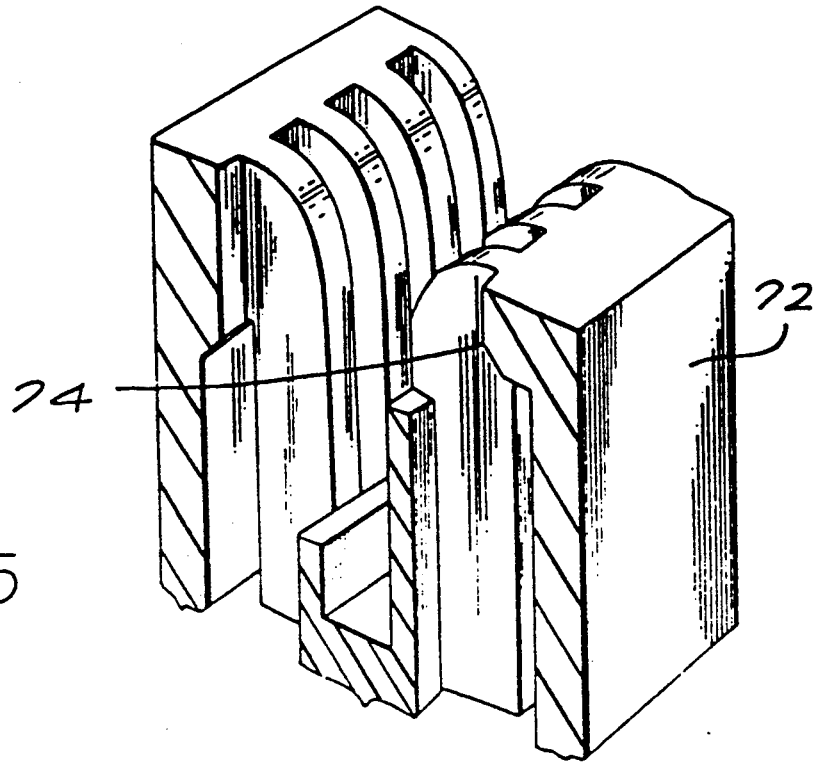
FIG. 5

CONNECTOR INTERCEPTOR PLATE ARRANGEMENT

CROSS REFERENCE TO RELATED APPLICATION

This is a continuation-in-part of U.S. patent application Ser. No. 07/525,936 filed May 18, 1990, now U.S. Pat. No. 5,035,632, which is a continuation-in-part of Ser. No. 07/419,405 filed Oct. 10, 1989, U.S. Pat. No. 4,950,172.

BACKGROUND OF THE INVENTION

As clock speeds of electrical systems increase, attention has to be paid to connectors that connect circuit boards to one another or to other peripherals, in order to prevent signal degradation at the connectors. Crosstalk between adjacent contacts can be a problem. An industry standard used for CPU (central processor unit) in the PC (personal computer) market is EISA (Extended Industry Standard Architecture) which relates to a bus that operates at 40 MHz (megahertz). More recent CPU buses operate at frequencies as high as 100 MHz or even higher. A connector which greatly reduced crosstalk between contacts as well as outside interference would be of considerable value.

SUMMARY OF THE INVENTION

In accordance with one embodiment of the present invention, a connector with at least one row of contact is constructed to greatly isolate the contacts from one another to prevent crosstalk between adjacent contacts as well as to avoid outside interference. Each contact has a mounted part held on an insulative mount and an elongated leg. The legs of a row of contacts have portions that lie substantially coplanar, and an interception plate is provided near the leg portions to minimize crosstalk. The interception plate, which is maintained at a controlled constant or periodically varying potential, extends along a plane that is close to and parallel to the plane of the contact leg portions. Each interceptor plate is close enough to a contact leg so there is a large area of the contact leg facing the plate, and there is much better capacitive coupling between the plate and each contact than between adjacent contacts. The capacitance between the interception plate and an adjacent contact is over three times as great as the capacitance between two adjacent contacts, to minimize crosstalk between adjacent contacts. The material (air or a special solid dielectric) between the interception plate and each contact, has a dielectric constant that varies by less than four percent between 1 kHz and 100 MHz, to avoid significant lengthening of pulses.

The novel features of the invention are set forth with particularity in the appended claims. The invention will be best understood from the following description when read in conjunction with the accompanying drawings.

BRIEF DESCRIPTION OF THE DRAWINGS

FIG. 4 is a bottom isometric view of an interceptor of the connector of FIG. 1.

FIG. 5 is a partial isometric view of the housing insulator of FIG. 2.

DESCRIPTION OF THE PREFERRED EMBODIMENTS

Figure 1:
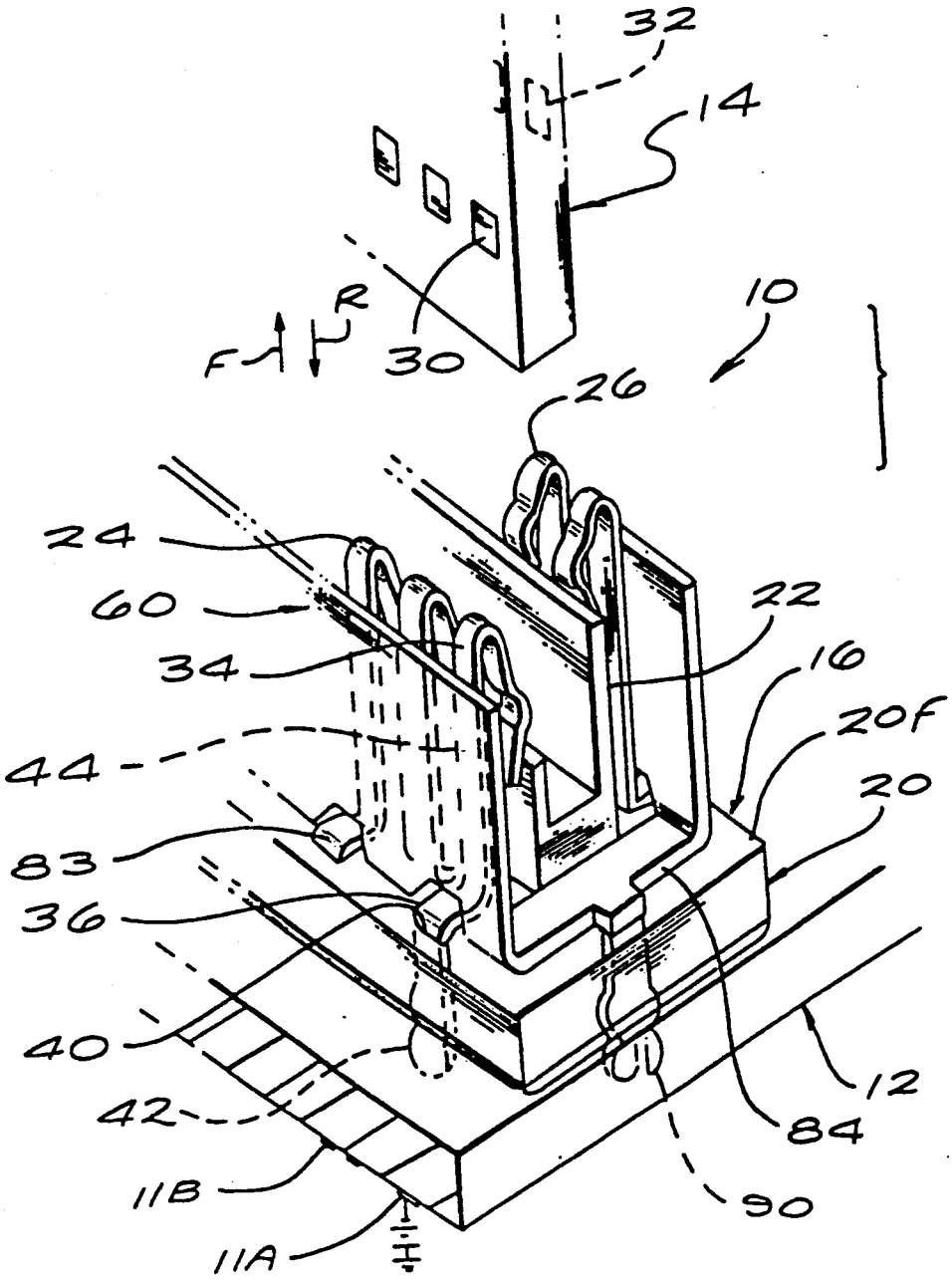
FIG. 1 is a partial isometric view of a connector of one embodiment of the invention, shown without the insulation in place, and showing how it is used with two perpendicular circuit boards.
Figure 3:
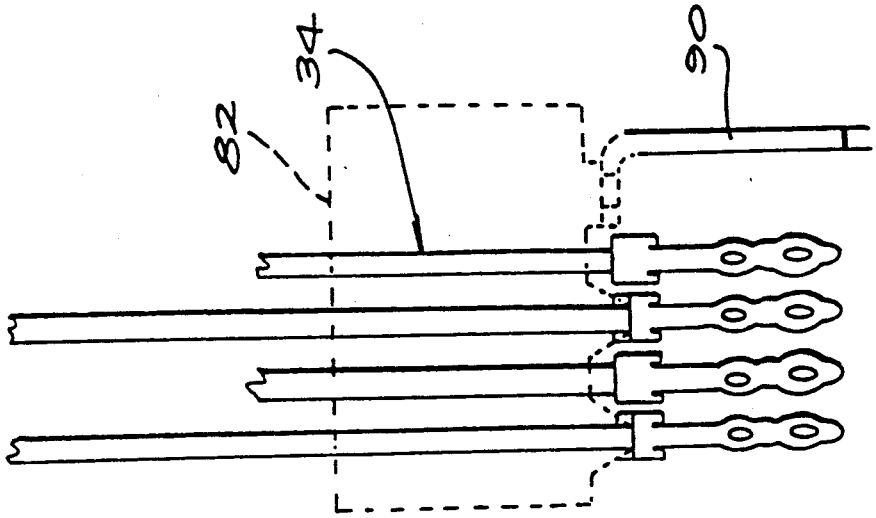
FIG. 3 is a partial side elevation view of the connector of FIG. 1.

FIG. 1 illustrates a connector 10 which is used to connect conductors such as 11A, 11B on first and second circuit boards 12, 14. The connector has a housing 16 that includes a support 20 held on the first circuit board 12. The housing also includes a board or card end receiver 22 that is held on the support and that receives the second circuit board 14 to a final position against a rear face of the receiver. The connector includes first and second rows of contacts 24, 26 for contacting rows of conductive pads 30, 32 on the second circuit board.

Figure 2:
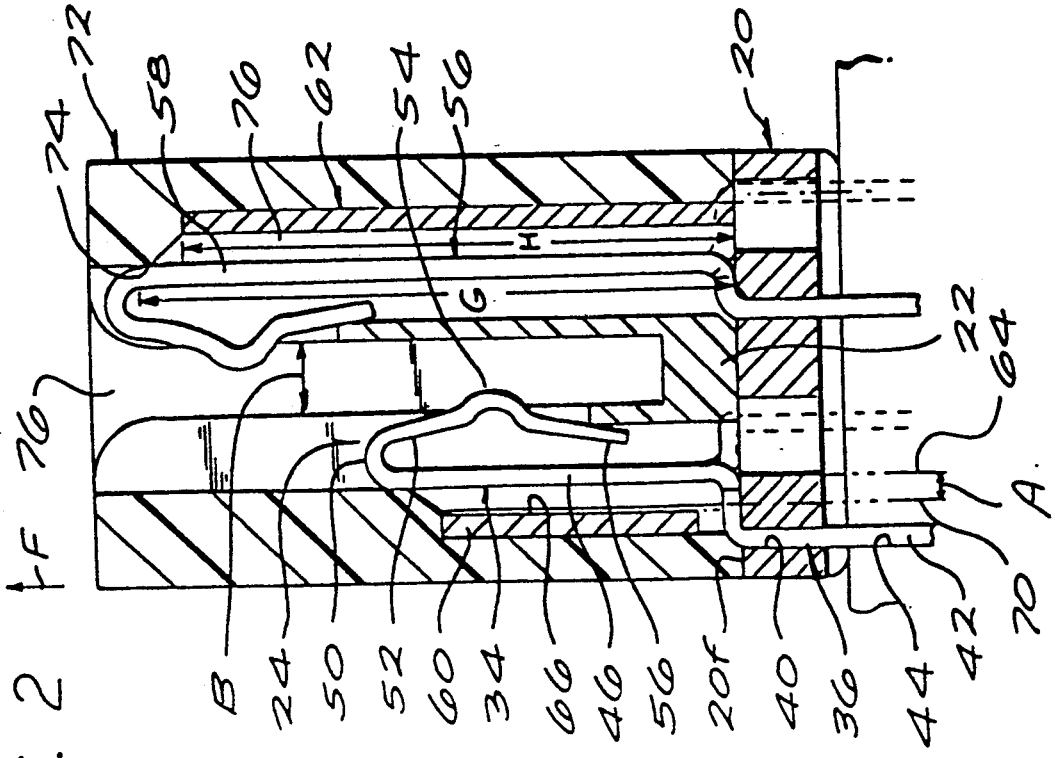
FIG. 2 is a sectional view of the connector of FIG. 1, but with the housing insulator in place.

As shown in FIG. 2, each contact such as 34 includes a mounted part 36 that extends along the front face 20*f* of the support 20 and closely through a hole 40 in the support. In this system, the mount part has a rearward end 42 that is electrically connected and fixed to a plated-through hole 44 in the first circuit board. Each contact also has an elongated leg 46 that extends forwardly, in the direction of arrow F, from the mounted part 36. The contact has a substantially 180° loop 50 at the forward end of the leg, and has a reverse arm 52 extending largely rearwardly from the loop, the reverse arm having a protrusion 54 for contacting a pad on the second circuit board. The reverse arm also has a rearward end 56 that bears against a side of the receiver 22. Each contact such as 56 of the second row is similar, except that its leg 58 is longer.

In accordance with the present invention, the connector includes a pair of interception plates 60, 62 that minimize cross talk between each contact and adjacent contacts of the same or other row. The elongated legs such as 46 of the contacts in a row such as 24 all lie substantially in a common imaginary plane 64. The contacts such as 34 are formed from strips of metal having a greater width than thickness, and the plane 64 lies at the faces of the contact legs that are closest to the interception plate 60. The plate 60 has an inner face 66 that lies in an imaginary plane 70 that is parallel to the plane 64 of the contact legs. The distance A between adjacent faces of the contact legs and interception plate is small, so there can be close capacitive coupling of the interception plate with the contact leg of each contact of a row of contacts.

Figure 6:
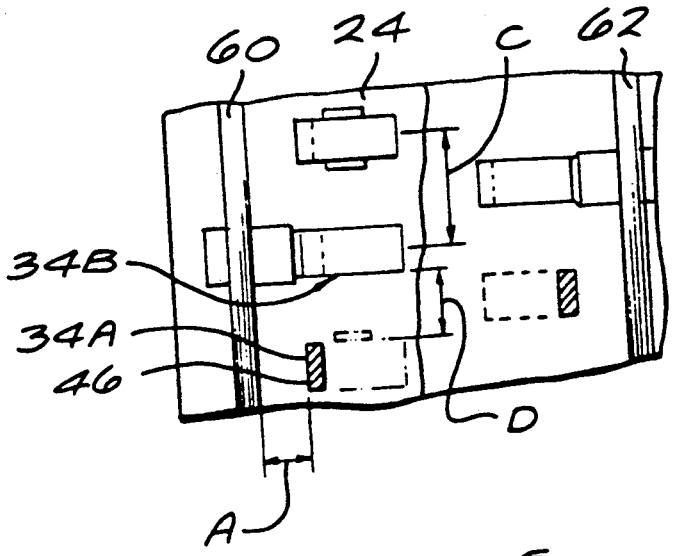
FIG. 6 is a partial plan view of the connector of FIG. 1.

The distance A between the interceptor plate and the contact legs is less than the distance B between adjacent rows of contacts when the two rows of contacts engage the second circuit board. Also, as shown in FIG. 6, the distance A is less than the row spacing distance C by which contacts in the row 24 are spaced apart. In fact, the distance A is preferably no more than the distance or length D of the gap between adjacent contacts 34A, 34B. Even if the distances A and D were equal, there would be closer coupling between each contact leg 46 and an adjacent interceptor plate 60 because the adjacent faces of the plate and leg 46 have greater areas than the adjacent surfaces of the two contacts 34A, 34B.

As shown in FIG. 2, the height H of each interception plate such as 62 is more than half the height G of the adjacent contact leg 58. The connector housing includes an insulator 72 with a location 74 that backs the forward end of the contact leg to limit its deflection away from the region 76 where the second circuit board is received. The interception plate such as 62 extends slightly below this insulator location 74 so that the space 76 between each contact leg and interception plate can be substantially empty. That is, the space 76 is substantially devoid (at least 90% of the space is empty) of solid material including insulation. By providing a substantially empty space between the plate and contact leg, applicant avoids degradation of capacitive coupling that would result from the presence of (solid) material in the space.

Applicant prefers that the height H of the plate be at least about 75% and preferably at least 90% of the height G of the contact leg 58. The fact that the contact legs are substantially coplanar allows the relatively simple interception plate to lie facewise close to the large areas of all contacts of the adjacent row. The interception plates also provide shielding against radio frequency interference although this is a secondary consideration.

As shown in FIG. 4, the interception plates 60, 62 are parts of an interceptor 82 which is formed of a copper alloy for good electrical conduction. Each plate has recesses 83 in its rear edge, through which pass the mounted parts 36 of alternated contacts of a row. The interceptor includes bridges 84, 86 that connect the plates and that are integral with them. The bridges lie facewise adjacent to the upper surface 20*f* (FIG. 1) of the support. The interceptor has pins 90, 92 that pass through holes in the support and that engage plated-through holes in the first circuit board. The pins 90 are connected to a source of controlled potential which is preferably DC such as ground, although it may vary regularly, or periodically. Actually, applicant prefers to connect the pins and therefore all of the interceptor to a source which has a potential at least as low as or lower than the potential on any of the contacts that lie adjacent to either of the plates. Thus, in a computer system wherein the extreme voltages are +12 volts and −12 volts, and the signal pins carry high frequency signals that are between these voltages, applicant prefers to maintain the interceptor and its plates 60, 62 at a potential of no more than −12 volts, (DC or peak-to-peak periodically varying and varying phase angle), and preferably below that, such as −15 volts. By maintaining the interceptor plates at a voltage below that of any of the contacts, applicant sets up an appreciable electric field between each contact and the interceptor plate. This electric field influences adjacent magnetic fields so that magnetic fields around any contact carrying a high frequency signal do not extend with appreciable intensity to the vicinity of adjacent contacts, to avoid cross-talk. In FIG. 1, the conductor 11A that connects to the interceptor pin 90, is shown as at a voltage below ground.

Figure 8:
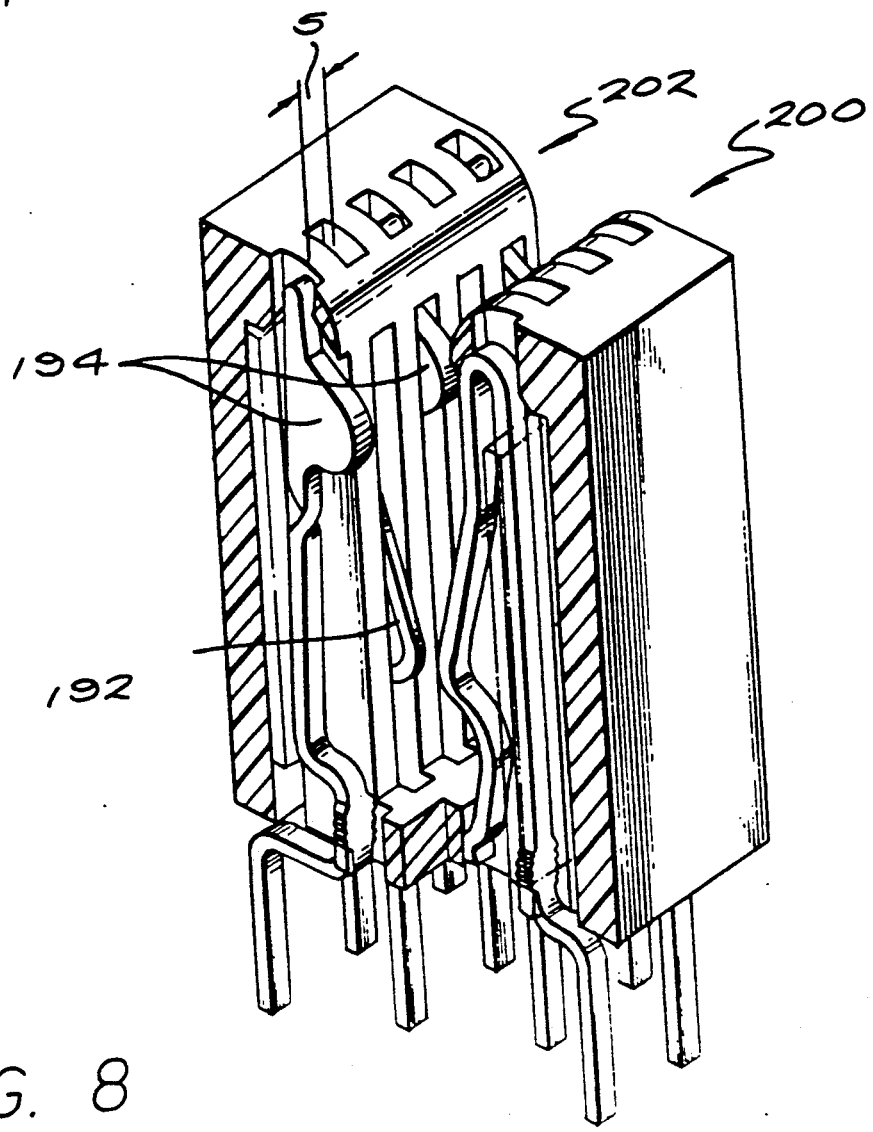
FIG. 8 is a partial perspective view of the connector of FIG. 7.
Figure 7:
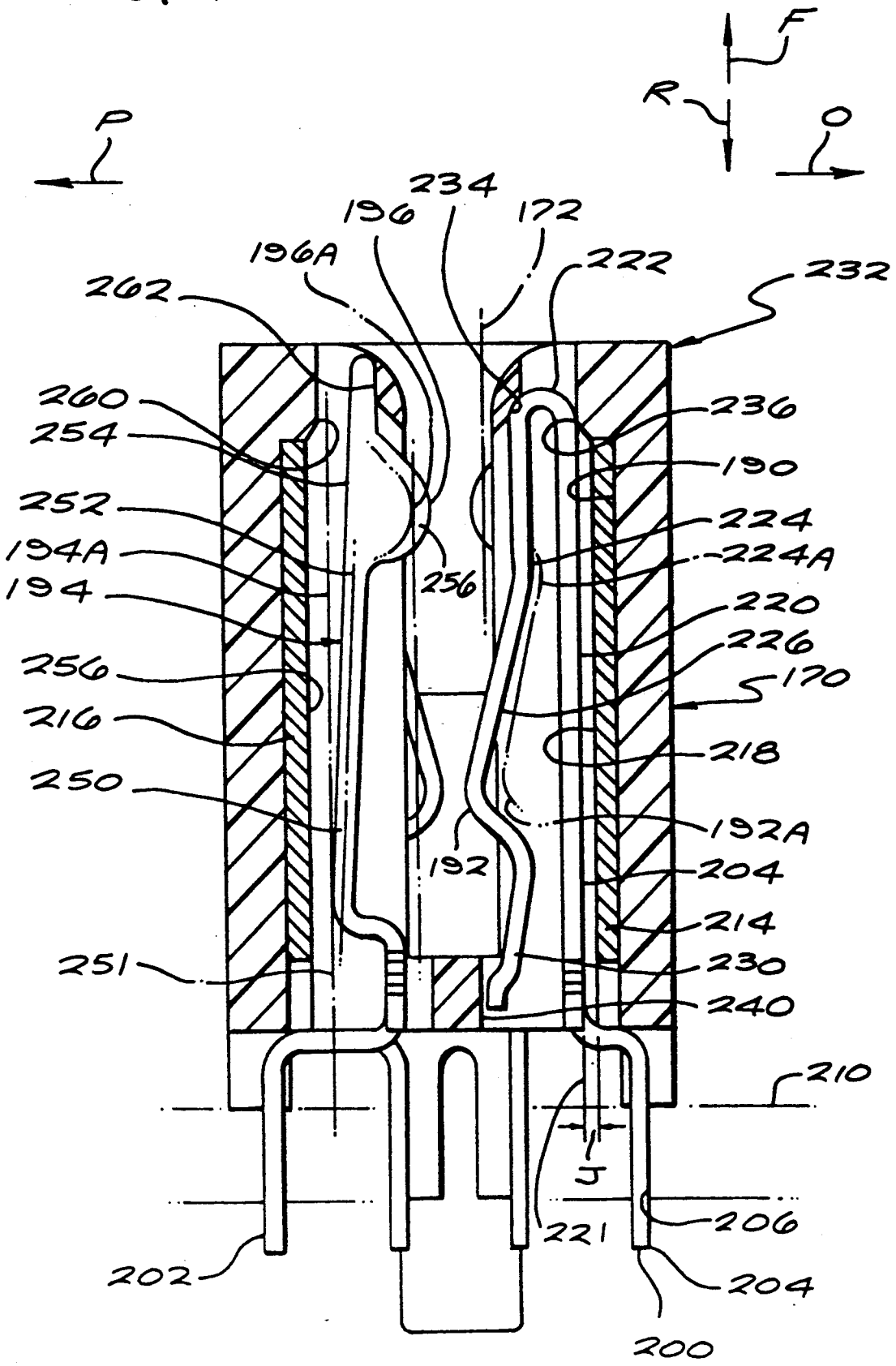
FIG. 7 is a sectional view of a connector constructed in accordance with another embodiment of the invention.
Figure 9:
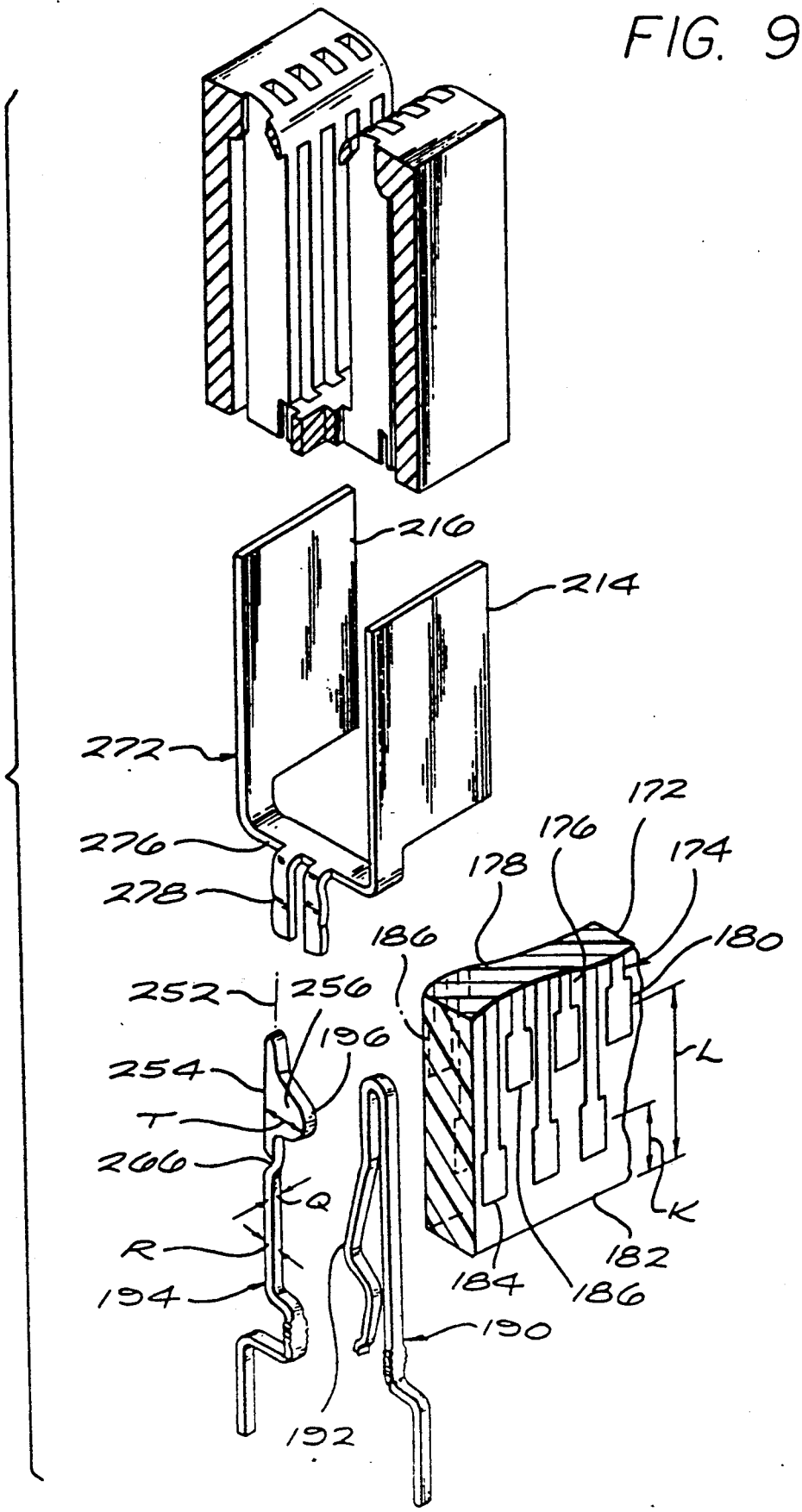
FIG. 9 is a partial exploded view of the connector of FIG. 7.

FIGS. 7–9 illustrate another connector 170 which is a card connector that receives a circuit board card 172 and connects to conductive traces on the card. As shown in FIG. 9, the card 172 has traces 174 on its opposite faces 176, 178, with each trace having a pad 180 where a contact of the connector can engage the trace. The pads on each face of the card alternate in distance from a card leading edge 182, with a first group of pads 184 lying a first distance K from the card leading edge and with a second group of pads 186 lying a greater second distance L from the card leading edge. The connector has two types of contacts, including a first type 190 with a contact location 192 that can lie close to the card leading edge to engage the first pads 184. A second type contact 194 has a contact location 196 which is spaced further from the card leading edge to engage the second pads 186. Both types of contacts are constructed to provide a long bendable contact region to provide considerable resilience.

As shown in FIG. 7, the contacts are arranged in first and second rows 200, 202, with the contacts of each row including a mounted part 204 lying in a hole 206 of a housing insulative support 210, which can lie on a circuit board or which can be a circuit board. A pair of interception plates 214, 216 of electrically conductive material each have an inner face such as 218 lying parallel and close to one of the rows of contacts, with the two rows of contacts lying between the two plates. The contacts are spaced apart to receive the card 172 between them. When the card is received, the contact locations 192, 196 move outwardly to the positions 192A, 196A. It should be noted that each row of contacts has both the first and second types of contacts.

The first type of contact 190 has a leg 220 that extends straight in the forward direction F, in a plane 221 that is parallel to the inner face 218 of the adjacent interception plate 214. The contact has a forward portion 222 extending in a substantially 180° loop away from the adjacent plate, and a reverse arm 224 extending largely rearwardly in the direction R. The reverse arm has a protrusion 226 bent away from the adjacent plate 214 and forming the contact location 192. The reverse arm has a rear end at 230. When a circuit board card is received in the position 172, the reverse arm of the contact bends to the position 224A.

The leg 220 of the contact 190 is closely controlled in position so that it extends parallel to the plate inner face 218, and with a small but controlled spacing J between them. As discussed above, it is desirable that the spacing distance J be as small as possible to provide maximum capacitive coupling between the contact and interception plate, but that the spacing be great enough to avoid direct contact between them. The connector housing includes an upstanding insulator 232 which controls the position of the interception plate 214, and which has inner and outer stops 234, 236. The second or front portion 222 of the contact substantially abuts the two stops to control its position. The abutment of the contact front portion with the outer stop 236 is of greatest importance, in that it prevents direct engagement of the contact with the interception plate, and because the contact will normally be pressed against the outer stop 236 when a card is installed that presses the contact in an outward direction O towards an adjacent interception plate 214. The upstanding insulator forms an additional stop 240 that can abut the rear end 230 of the contact to control the position of the rear end. Such control is useful to prevent contacts from touching one another before a card is installed.

The contact 190 provides a long reverse arm 224 that can resiliently deflect to engage a trace on an installed card, and also provides a long leg 220 which lies close to the interception plate to assure good capacitive coupling between them.

The second type contact 194 includes a forwardly projecting leg 250 with most of its length being of uniform width along an imaginary centerline 252. The contact leg also includes a forward portion 254 having an enlargement 256 containing the contact location 196. When the card 172 is installed, and the contact is deflected to the position 194A, the leg 250 lies substantially in a plane 251 close to and parallel to an inner face 256 of the interception plate 216. An outer stop 216 limits outward movement, in the direction P of the second contact towards the interception plate, while an inner stop 262 limits opposite inward movement.

All of the contacts, including the second type 194, are formed by stamping them from a metal sheet. Each contact is formed so it has a greater width Q (FIG. 9) than its thickness R. This enables easier deflection of the contact and also results in a greater area of each contact lying adjacent to a corresponding interception plate. The contacts are formed from a sheet of the thickness R. However, the enlargement 256 has a solid thickness T several times greater than that of the sheet. In order to facilitate manufacture of the second type contact 194, applicant forms the enlargement 256 so it initially extends in the plane of the sheet of metal of thickness R. After the contact is punched out of the sheet, the outer contact portion 254 is twisted 90° about the centerline 252 of the contact at location 266. This results in the enlargement projecting towards the card to hold the contact location 196 adjacent to the card, in a contact of rugged construction.

Referring again to FIG. 7, it can be seen that each of the interception plates extends along more than 75% of the height of each contact leg, and that there is no insulation between each interception plate and an adjacent contact. The outer stops such as 236 and 260 lie above the top of the interception plate.

As shown in FIG. 8, the two types of contacts alternate in each row, so that in the first row 200 the contact types 192 and 194 alternate, and the same occurs along the second row 202. As shown in FIG. 9, the interception plates are part of an interceptor 274 similar to that of FIG. 1, which includes a bridge 276 and a slotted pin 278.

Applicant has designed a connector of the type illustrated in FIG. 7-9, with the distance S (FIG. 8) between adjacent surfaces of contacts of a row being about 20 mil (one mil equals one thousandth inch) and with the distance J (FIG. 7) between a contact leg and an adjacent interception plate in the deflected position of the contact being 10 mil.

Figure 10:
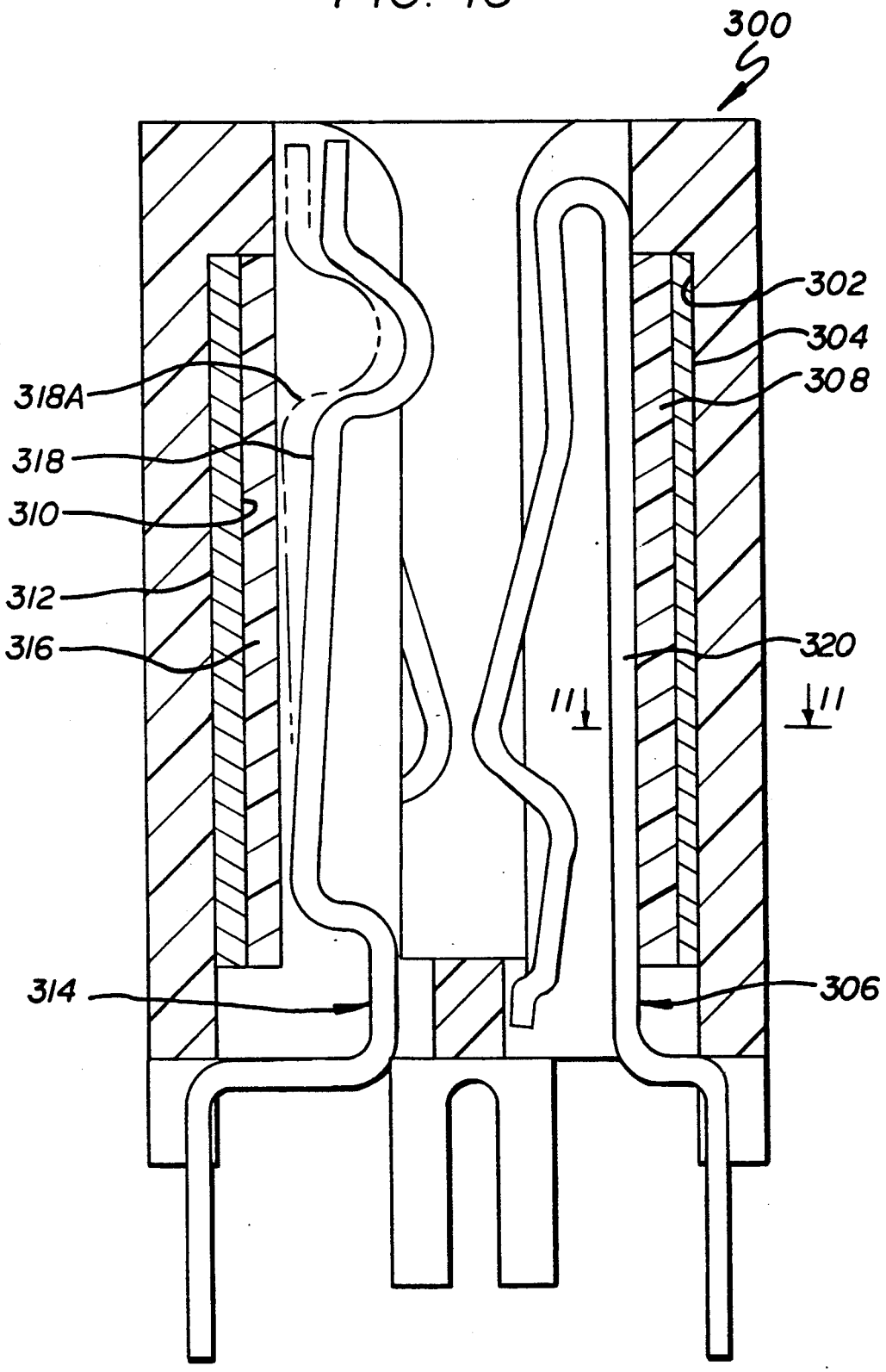
FIG. 10 is a sectional view of a connector constructed in accordance with another embodiment of the invention.
Figure 11:
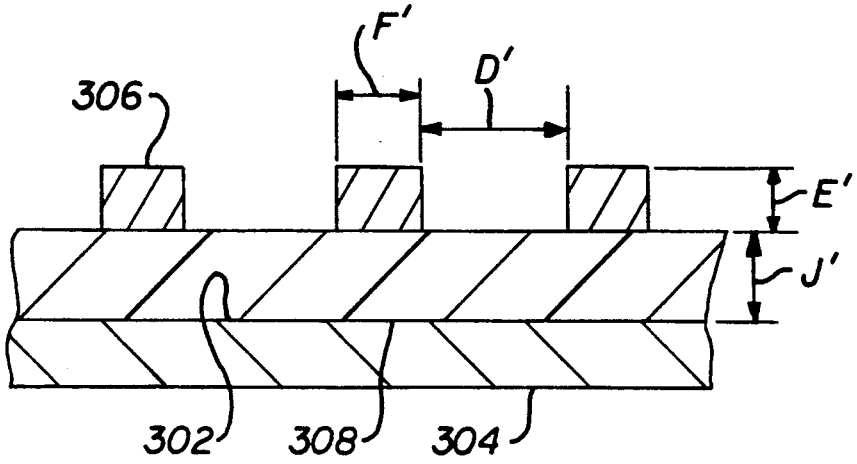
FIG. 11 is a partial view taken on line 11—11 of FIG. 10.

FIGS. 10 and 11 illustrate another connector 300 that is similar to the connector of FIG. 7, except that the space 302 between the interceptor plate 304 and each contact 306 of a row is filled primarily with a solid dielectric 308. The other space 310 between the other interceptor plate 312 and the contact 314 of another row is also filled primarily with a solid dielectric 316, at least when the leg 318 of the contact 114 is in its fully deflected position at 318A.

Applicant finds that a very important characteristic of any dielectric material(s) lying between the interceptor plate such as 304 and the leg 320 of a corresponding contact, is that the dielectric constant of the material remain constant through substantially all frequencies or frequency components of signals passing through the contacts. Currently used circuits constructed in accordance with EISA (Extended Industry Standard Architecture) commonly carry signals having frequency components as high as 100 MHz (megahertz) and sometimes as high as 300 MHz, with the lowest frequency component being as low as about 1 kHz (kilohertz). This architecture is commonly used in buses of advanced personal computers. Among the many requirements of such circuitry is that the length of pulses traveling through the buses and through the contacts of any connector, not be appreciably lengthened. It is generally required that the increase in pulse length (due to increases in the rise and fall times of the leading and trailing edges of the pulse) not be greater than five percent, and preferably not more than 2.5 percent. Applicant has found that a major factor that can lengthen pulses in a connector having an interceptor plate as described above, is changes in the dielectric constant of material (e.g. 308) lying between the interceptor plate and contacts of an adjacent row.

Applicant's studies show that if the dielectric constant of the material changes by about four percent in the relevant frequencies (1 kHz to 100 MHz) then the pulse width can lengthen by about five percent. If the dielectric constant varies by two percent at the opposite extremes of frequency, then the pulse length can increase by about 2.5 percent. Thus, any dielectric material between the interceptor plate and an adjacent row of contacts should have a dielectric constant that does not vary by more than four percent, and preferably by no more than two percent, between 1 kHz and 100 MHz.

Air has a dielectric constant of 1.0 that does not vary for electromagnetic field between 1 kHz and 100 MHz passing through it. Most connectors currently manufactured are made of polyester plastic, which has a dielectric constant of about 3.0, with the dielectric constant varying between about ten percent and forty four percent between 1 kHz and 100 MHz, with a 10 percent variation being about the lowest for polyester compositions. Nylon is sometimes used in connectors, with Nylon commonly having a dielectric constant of about 3.0, and varying between about 16 percent and over 100 percent in the above frequency range, with the best Nylon varying by about 16 percent.

Applicant finds that a small minority of plastics have a dielectric constant that varies by less than four percent or less than two percent. TEFLON (a polytetrafluoroethylene sold by duPont company) which has a dielectric constant of 2.1, CRYSTALOR (a polymethypentene sold by Phillips Petroleum) which has a dielectric constant of about 3.0 and AMODEL (a polyphthalamide sold by Amoco corporation) which has a dielectric constant of about 3.7, all have dielectric constants that vary by less than two percent between 1 kHz and 100 MHz. Some forms of polyethylene also have a dielectric constant which varies by less than two percent between 1 kHz and 100 MHz. Thus, where it is desired to use a solid dielectric between the interceptor plate and the contact (as to prevent them from touching) any of the above solid materials can be used as a dielectric that occupies some or most of the space between the interceptor plate and contacts.

As mentioned above, crosstalk between adjacent contacts is minimized by arranging the interceptor plates so the capacitance between the interceptor plate and each contact is much greater than the capacitance between adjacent contacts of a row. The crosstalk between adjacent contacts of a row, in the presence of an adjacent interceptor plate is given roughly by the formula:

$$\text{crosstalk} = \frac{C_D}{3C_j}$$

Where $C_D$ is the capacitance between the two contacts and $C_J$ is the capacitance between each contact and the interceptor plate. A crosstalk of 10 percent (the noise component of a signal passing through a contact due to adjacent contacts is ten percent of the amplitude of the signal passing through the adjacent contacts) is about the maximum that can be tolerated in most circuits. In that case, the capacitance $C_J$ between the interceptor plate and a contact must be at least three times the capacitance between two adjacent contacts. A crosstalk of no more than five percent is generally preferred, so a capacitance $C_j$ at least six times $C_D$ is preferred.

Although a relatively high capacitance between the interceptor plate and each contact is desirable to minimize crosstalk, it should be noted that the capacitance between the interceptor plate and each contact can act as a filter that prevents very high frequencies from passing through the contact. However, the interceptor plate would have to be very close to the contacts, before it seriously affects high frequency signals.

In a connector that applicant has constructed and successfully tested, each contact had a width F' (FIG. 11) of 14 mils (1 mil equals one thousandth inch) and a thickness E' of 14 mils. The separation D' between contacts was 31 mils, and the separation J' between each contact and the interceptor plate was 10 mils, in a case where the dielectric was air. For a dielectric such as TEFLON (dielectric constant of 2.1) the distance J' can be increased to about 20 mils, while for the insulation AMODEL mentioned above, the distance J' can be increased to about 37 mils for the same effect. In most cases, the distance J' will be less than the contact separation distance D'.

Figure 12:
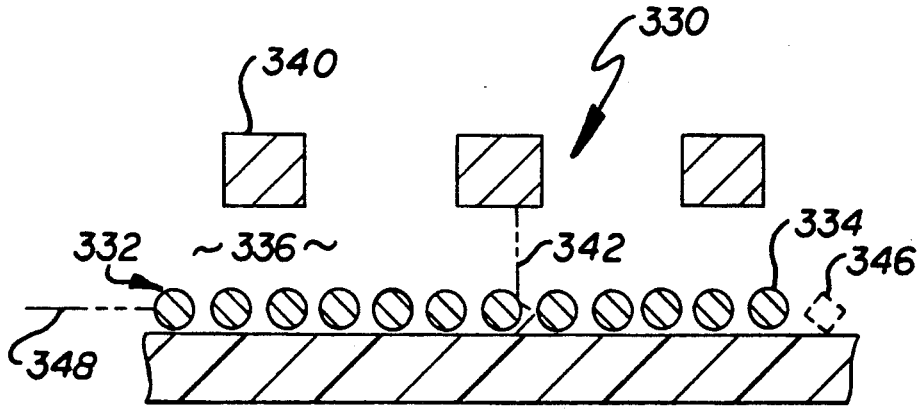
FIG. 12 is a partial sectional view of a connector constructed in accordance with another embodiment of the invention.

FIG. 12 illustrates a portion of a connector 330, where the interceptor plate 332 is in the form of a screen having multiple wires 334, and the space 336 between contacts 340 and the interceptor plate is filled with air. A large portion of electromagnetic radiation from each contact, such as indicated at 342, is reflected from the wires onto an insulator 344 where it is absorbed. This minimizes crosstalk due to reflections. The wires can have large flat faces closest to the contacts as indicated at 346, which are angled from the plane 348 of the plate. The surfaces of the round wires 334 closest to the contacts, also have most of their surface area angled from the plane of the interceptor plate so they are largely angled from the plane.

Thus, the invention provides a connector with an interception plate which lies along the length of a row of contacts adjacent to the contact legs, where the legs have faces that all lie substantially in a single plane, to isolate each contact from the others to avoid crosstalk, especially at high speed operation or high rate switching. The interception plate is at a controlled potential and lies close to a wide area of the contact legs to provide close capacitive coupling of the plate to the contact legs. The dielectric material between the interceptor plate and an adjacent row of contacts, is preferably no more than four percent between 1 kHz and 100 MHz to avoid lengthening of pulse widths. The capacitance $C_j$ between the interceptor plate and each contact, is more than three times the capacitance $C_D$ between adjacent contacts of a row.

Although particular embodiments of the invention have been described and illustrated herein, it is recognized that modifications and variations may readily occur to those skilled in the art and consequently it is intended to cover such modifications and equivalents.

We claim:

1. A connector comprising:

an insulative support;

a plurality of contacts arranged in a row with each contact including a mounted part in said support and an elongated leg extending primarily in a predetermined forward direction from said mounted part, with the legs of the contacts in said row lying substantially in an imaginary plane;

an interception plate of electrically conductive material lying in a plane extending parallel to said imaginary plane of said row, said interception plate lying a distance J from the contacts of said row of contacts, said contacts in said row being spaced apart by a distance D, and said interception plate having at least a portion adjacent to a plurality of said contacts and at a predetermined potential;

the space between each said contact leg and said adjacent interception plate being filled with a dielectric having a dielectric constant that varies by less than four percent between 1 kHz and 100 MHz; and the capacitance between each of said contacts and said interception plate, is at least three times the capacitance between adjacent contacts of said row.

2. The connector described in claim 1 wherein:

the capacitance between each of said contacts and said interception plate is at least six times the capacitance between adjacent contacts of said row.

3. The connector described in claim 1 wherein:

said dielectric which fills said space between each said contact leg and said adjacent interception plate has a dielectric constant that varies by less than two percent between 1 kHz and 100 MHz.

4. The connector described in claim 1 wherein:

more than half of said dielectric which fills said space between each said contact leg and said adjacent interception plate, is air.

5. A connector comprising:

an insulative support;

a row of contacts with each contact including a mounted part in said support and an elongated leg extending primarily in a predetermined forward direction from said mounted part, with the legs of the contacts in said row lying substantially in an imaginary plane;

an interception plate of electrically conductive material lying in a plane extending parallel to said imaginary plane of said row, said interception plate lying closer to the contacts of said row of contacts than the distance between said contacts in said row, and said interception plate having at least a portion adjacent to a plurality of said contacts and at a predetermined potential; and the space between each said contact leg and said adjacent interception plate contains a dielectric having a dielectric constant that varies by no more than four percent between 1 kHz and 100 MHz.

6. The connector described in claim 5 wherein:

said dielectric is chosen from the group of materials which consists of polytetrafluoroethylene, polymethypentene, polyphthalamide, and air.

7. A connector comprising:

a housing having a support;

first and second rows of contacts in said housing with each row of contacts including a mounted part in said support and an elongated leg extending in a predetermined forward direction from said mounted part, with the legs of the contacts in a row all lying substantially in an imaginary plane;

a pair of interception plates of electrically conductive material, each interception plate lying in a plane extending parallel to a said imaginary plane of a said row of contact legs, said interception plates lying on opposite sides of the space between said first and second rows of contacts, and each interception plate having at least a portion adjacent to a plurality of said contacts and at a predetermined constant potential;

wherein said housing includes insulation between the contacts of a row and on a side of each plate opposite a corresponding row of contacts, with the space between each contact leg and an adjacent interception plate containing a dielectric having a dielectric constant that varies by no more than four percent between 1 kHz and 100 MHz; and wherein the capacitance between each of said plurality of contacts and said interception plate is at least three times the capacitance between adjacent contacts of a row.

8. The connector described in claim 7 wherein:

said interception plates each lie closer to the contacts of an adjacent row than the distance between adjacent contacts in each row.

* * * * *